US008281503B2

(12) United States Patent
Savill, Jr.

(10) Patent No.: US 8,281,503 B2
(45) Date of Patent: Oct. 9, 2012

(54) MULTI-POSITION HEEL

(76) Inventor: Robert F. Savill, Jr., Levittown, NY (US)

( * ) Notice: Subject to any disclaimer, the term of this patent is extended or adjusted under 35 U.S.C. 154(b) by 992 days.

(21) Appl. No.: 12/233,860

(22) Filed: Sep. 19, 2008

(65) Prior Publication Data

US 2010/0071233 A1 Mar. 25, 2010

(51) Int. Cl.

| | |
|---|---|
| ***A43B 13/34*** | (2006.01) |
| ***A43B 21/24*** | (2006.01) |
| ***A43B 3/24*** | (2006.01) |
| ***A43B 21/00*** | (2006.01) |

(52) U.S. Cl. ..... 36/100; 36/105; 36/34 R; 36/39

(58) Field of Classification Search ..... 36/97, 100, 36/105, 34 R, 39, 42, 61

See application file for complete search history.

(56) References Cited

U.S. PATENT DOCUMENTS

| | | | | |
|---|---|---|---|---|
| 2,258,265 | A * | 10/1941 | Schwartz | 36/100 |
| 2,767,489 | A | 10/1956 | Sturman | |
| 3,464,126 | A | 9/1969 | Sarkissian | |
| 3,797,136 | A * | 3/1974 | Soleri | 36/42 |
| 3,805,418 | A | 4/1974 | Matuka et al. | |
| 4,416,072 | A | 11/1983 | Sarkissian | |
| 4,670,996 | A * | 6/1987 | Dill | 36/42 |
| 4,805,320 | A * | 2/1989 | Goldenberg et al. | 36/42 |
| 5,079,857 | A * | 1/1992 | Clifton | 36/42 |
| 5,309,651 | A | 5/1994 | Handel | |
| 5,410,821 | A * | 5/1995 | Hilgendorf | 36/100 |
| 5,542,198 | A * | 8/1996 | Famolare | 36/130 |
| 5,887,360 | A * | 3/1999 | Bucalo et al. | 36/100 |
| 6,021,586 | A * | 2/2000 | Bucalo et al. | 36/42 |
| 6,662,475 | B2 * | 12/2003 | Lewia | 36/130 |
| 6,785,987 | B2 | 9/2004 | Bucalo et al. | |
| 6,813,847 | B2 * | 11/2004 | Workman | 36/15 |
| 2007/0289167 | A1 | 12/2007 | Pieriboni | |
| 2008/0184598 | A1 | 8/2008 | Handel | |

* cited by examiner

*Primary Examiner* — Khoa Huynh
*Assistant Examiner* — Melissa Lalli
(74) *Attorney, Agent, or Firm* — Andrew M. Calderon; Roberts Mlotkowski Safran & Cole, P.C.

(57) ABSTRACT

A multi-position heel assembly is structured and arranged to be integrally formed with or mechanically connected to a shoe. The assembly includes: a chassis; a heel connected to the chassis and rotatable relative to the chassis about an axis; and a locking mechanism including an actuator that is axially translatable along the axis. The locking mechanism selectively allows rotation of the heel relative to the chassis.

20 Claims, 8 Drawing Sheets

MULTI-POSITION HEEL

BACKGROUND OF THE INVENTION

1. Field of the Invention

The present invention relates generally to shoes, and more specifically to a system for providing a multiple position heel for shoes.

2. Discussion of Background Information

People who wear high heel shoes, women in particular, have never had the luxury of being able to change their shoe style from a high heel to a low heel, or vice versa, in a convenient manner. Adjustable heels are known in the art; however, all of the known systems are cumbersome to operate and/or structurally deficient.

Accordingly, there exists a need in the art to overcome the deficiencies and limitations described hereinabove.

SUMMARY OF THE INVENTION

According to a first aspect of the invention, there is a multi-position heel assembly structured and arranged to be integrally formed with or mechanically connected to a shoe. The assembly comprises: a chassis; a heel connected to the chassis and rotatable relative to the chassis about an axis; and a locking mechanism comprising an actuator that is axially translatable along the axis, wherein the locking mechanism selectively allows rotation of the heel relative to the chassis.

In embodiments, the locking mechanism is structured and arranged to place the heel in one of a first state and a second state. In the first state, the locking mechanism prevents rotation of the heel relative to the chassis. In the second state, the locking mechanism permits rotation of the heel relative to the chassis.

The actuator may comprise a pushbutton biased toward a first position corresponding to the first state in which the locking mechanism prevents rotation of the heel relative to the chassis. The actuator may further comprise a spring that biases the pushbutton. The pushbutton may be translatable along the axis between the first position and a second position. In embodiments, the second position corresponds to the second state in which the locking mechanism allows rotation of the heel relative to the chassis. In further embodiments, the pushbutton is substantially flush with an outermost side surface of the heel in the first position, and is recessed from the outermost side surface of the heel in the second position.

In accordance with aspects of the invention, the heel is arranged to be locked in one of a first heel position and a second heel position relative to the chassis. The first heel position provides the shoe with a first heel height, and the second heel position provides the shoe with a second heel height. The first heel height may be the same as or different from the second heel height.

In embodiments, the heel further comprises a first engagement surface associated with the first heel position, and a second engagement surface associated with the second heel position. The first engagement surface is composed of a first material, and the second engagement surface is composed of a second material. The first material may be the same as or different from the first material. Moreover, the first engagement surface and the second engagement surface have differing tread patterns.

According to further aspects of the invention, when the heel is arranged in the first heel position, the first engagement surface is configured to contact the ground and the second engagement surface is configured to be located under an arch of the shoe. Moreover, when the heel is arranged in the second heel position, the second engagement surface is configured to contact the ground and the first engagement surface is configured to be visible from behind the shoe.

The first engagement surface may comprise at least one of: a tread pattern, a logo, and indicia The at least one of the tread pattern, the logo, and the indicia may be integrally formed with the first engagement surface.

In embodiments, the actuator comprises a pushbutton member having a shaft and a key at one end of the shaft. The key may be arranged to engage one of two slots formed in the chassis to prevent rotation of the heel relative to the chassis. The heel may comprise a cavity for accommodating the key when the key is disengaged from the two slots to allow rotation of the heel relative to the chassis.

In further embodiments, the actuator comprises a pushbutton member operatively connected to two pins. The two pins may be arranged to engage one of two pairs of holes formed in the chassis to prevent rotation of the heel relative to the chassis. The heel may comprise a cavity for accommodating the two pins when the two pins are disengaged from the two pairs of holes to allow rotation of the heel relative to the chassis.

According to a second aspect of the invention, there is a multi-position shoe, comprising: a chassis integrally formed with or connected to a sole of the shoe; a heel connected to the chassis and rotatable relative to the chassis about an axis; and a locking mechanism comprising a pushbutton that is axially translatable along the axis. Upon depression of the pushbutton, the locking mechanism selectively allows rotation of the heel relative to the chassis.

According to a third aspect of the invention, there is a multi-position shoe comprising: a chassis integrally formed with or connected to a sole of the shoe; a heel connected to the chassis and rotatable relative to the chassis between a first heel position and a second heel position; and a locking mechanism comprising a spring-biased pushbutton that is axially translatable between a first position and a second position along an axis of rotation of the heel. The heel is locked in one of the first heel position and the second heel position when the pushbutton is in the first position, and the heel is moveable between the first heel position and the second heel position when the pushbutton is in the second position.

According to a fourth aspect of the invention, there is a multi-position heel assembly comprising a chassis structured and arranged to be integrally formed with or mechanically connected to a shoe, wherein the chassis includes at least two detents radially spaced about an axis. The assembly, also comprises a heel pivotally connected to the chassis and a locking mechanism. The heel is arranged in a first heel position beneath the chassis when the locking mechanism is engaged with a first one of the at least two detents. Also, the heel is arranged in a second heel position beneath the chassis, different from the first heel position, when the locking mechanism is engaged with a second one of the at least two detents. Additionally, the heel is rotatable relative to the chassis about the axis when the locking mechanism is disengaged from the at least two detents.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention relates generally to shoes, and more specifically to a system for providing a multiple position heel for shoes. In embodiments of the invention, a multiple position heel is provided with an easy to use spring-loaded, pushbutton locking mechanism that allows the heel to selectively rotate from one position to another. According to aspects of the invention, the heel is structured and arranged to be positioned in one of two configurations, each configuration having a different height and associated wear surface. In this manner, the wearer may quickly and conveniently change the functionality and aesthetic appearance of their shoe.

Figure 1:
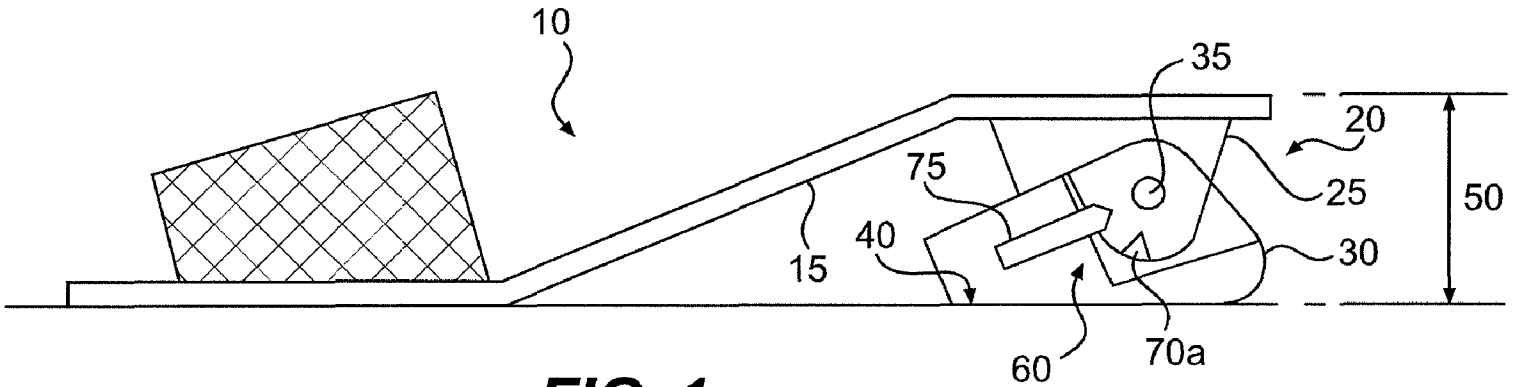
FIGS. 1 and 2 show a multi-position heel assembly according to aspects of the invention.
Figure 2:
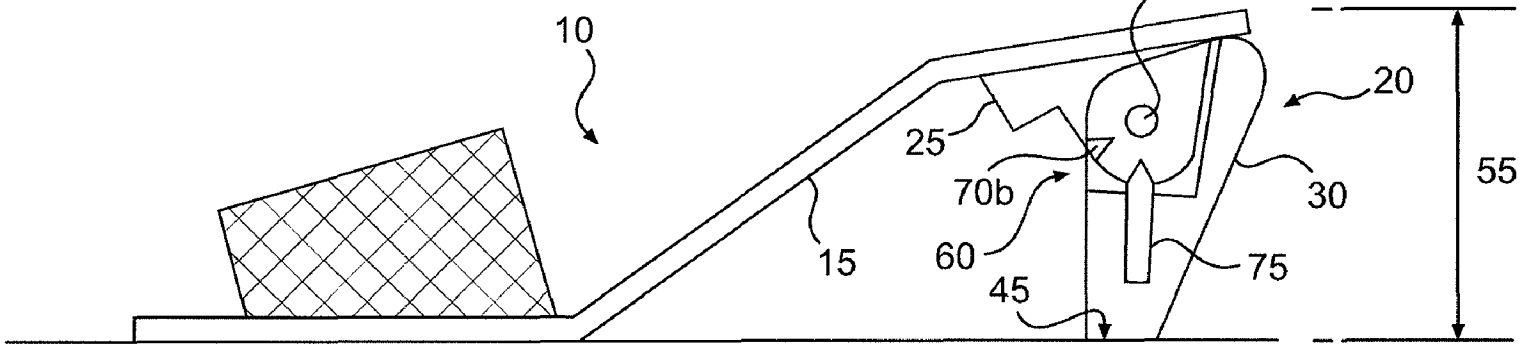

FIGS. 1 and 2 show a shoe 10 having a sole 15 and a multi-position heel assembly 20 according to aspects of the invention. In embodiments, the assembly 20 includes a chassis 25 attached to the sole 15 and a heel 30 pivotally attached to the chassis 25. The chassis 25 may be integral with the sole 15, for example, molded as a unitary piece. Alternatively, the chassis 25 may be permanently adhered to the sole 15. Alternatively, the chassis 25 may be mechanically connected to the sole 15, such as, for example, by shoe tack(s), threaded connection, adhesive, etc.

In embodiments, the heel 30 is selectively rotatable about axis 35, such that the heel 30 may be arranged in a first heel position (e.g., FIG. 1) or a second heel position (e.g., FIG. 2). In the first heel position, the heel 30 is positioned such that a first engagement surface 40 is arranged to contact (e.g., engage) the surface (e.g., ground, floor, walking surface, etc.) on which the shoe 10 rests. In the second heel position, the heel 30 is positioned such that a second engagement surface 45 is arranged to contact (e.g., engage) the surface (e.g., ground, floor, walking surface, etc.) on which the shoe 10 rests. Moreover, in the first heel position (e.g., FIG. 1), the assembly 20 is structured and arranged to provide the shoe 10 with a first heel height 50. In the second heel position (e.g., FIG. 2), the assembly 20 is structured and arranged to provide the shoe 10 with a second heel height 55, different from the first height 50. Accordingly, the first heel position and second heel position may be referred to as low heel and high heel positions, respectively, depending upon the relative heel height for each position. Alternatively, the first heel height may be substantially the same as the second heel height.

According to further aspects of the invention, the assembly 20 also includes a locking mechanism 60 for locking the heel 30 in the first heel position or the second heel position. For example, as depicted in FIGS. 1 and 2, the locking mechanism may comprise detents 70*a* and 70*b* in the chassis 25 and a spring-loaded lever 75 that is structured and arranged to engage one or the other detent 70*a* or 70*b*. In embodiments, a spring (not shown) biases the lever 75 toward engagement with one of the detents 70*a* and 70*b*. In this manner, a user may disengage the lever 75 from the detent 70*a* by overcoming the bias force of the spring, rotate the heel 30 to the other position, and release the lever 75, whereby the spring will urge the lever 75 into the detent 70*b* (and vice versa). It is noted that the invention is not limited to the locking mechanism 60 described with respect to FIGS. 1 and 2. Instead, other locking mechanisms, such as those described herein, may also be used within the scope of the invention.

Figure 3:
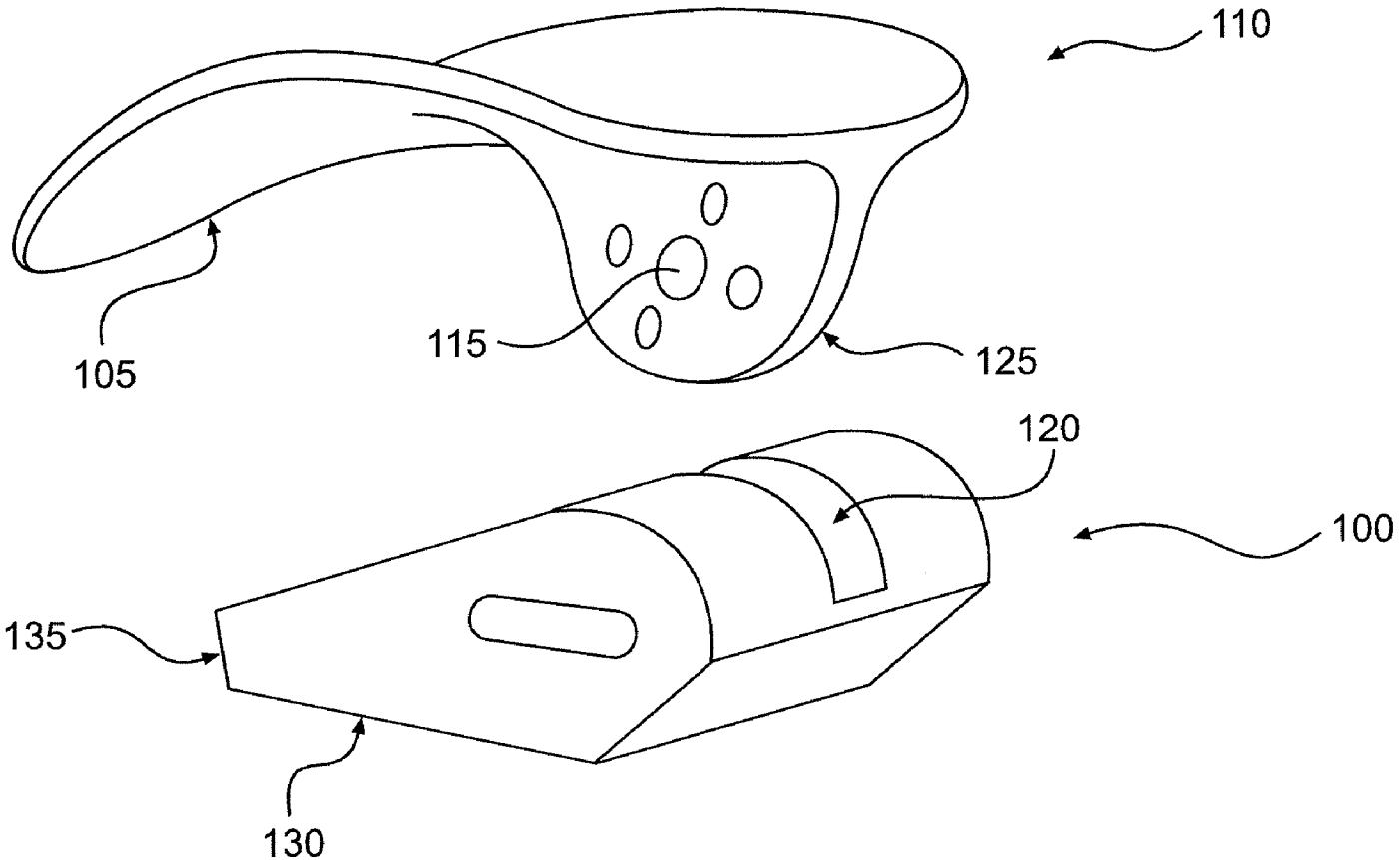
FIG. 3 shows an exploded view of an assembly according to aspects of the invention.

FIG. 3 shows an exploded view of an assembly according to aspects of the invention. In particular, FIG. 3 shows the assembly including a heel 100 and a chassis 110 that is integrally formed with a portion of an arch 105 of a shoe. In embodiments, the heel 100 and chassis 110 are structured and arranged to perform functions similar to heel 30 and chassis 25 (described with respect to FIGS. 1 and 2). For example, the heel 100 may be pivotably connected to the chassis 110, such that the heel 100 can be selectively rotated about axis 115. More specifically, the heel 100 may include a groove 120 into which a flange 125 of the chassis 110 is inserted. Moreover, the heel 100 may include first engagement surface 130 and second engagement surface 135.

Figure 4:
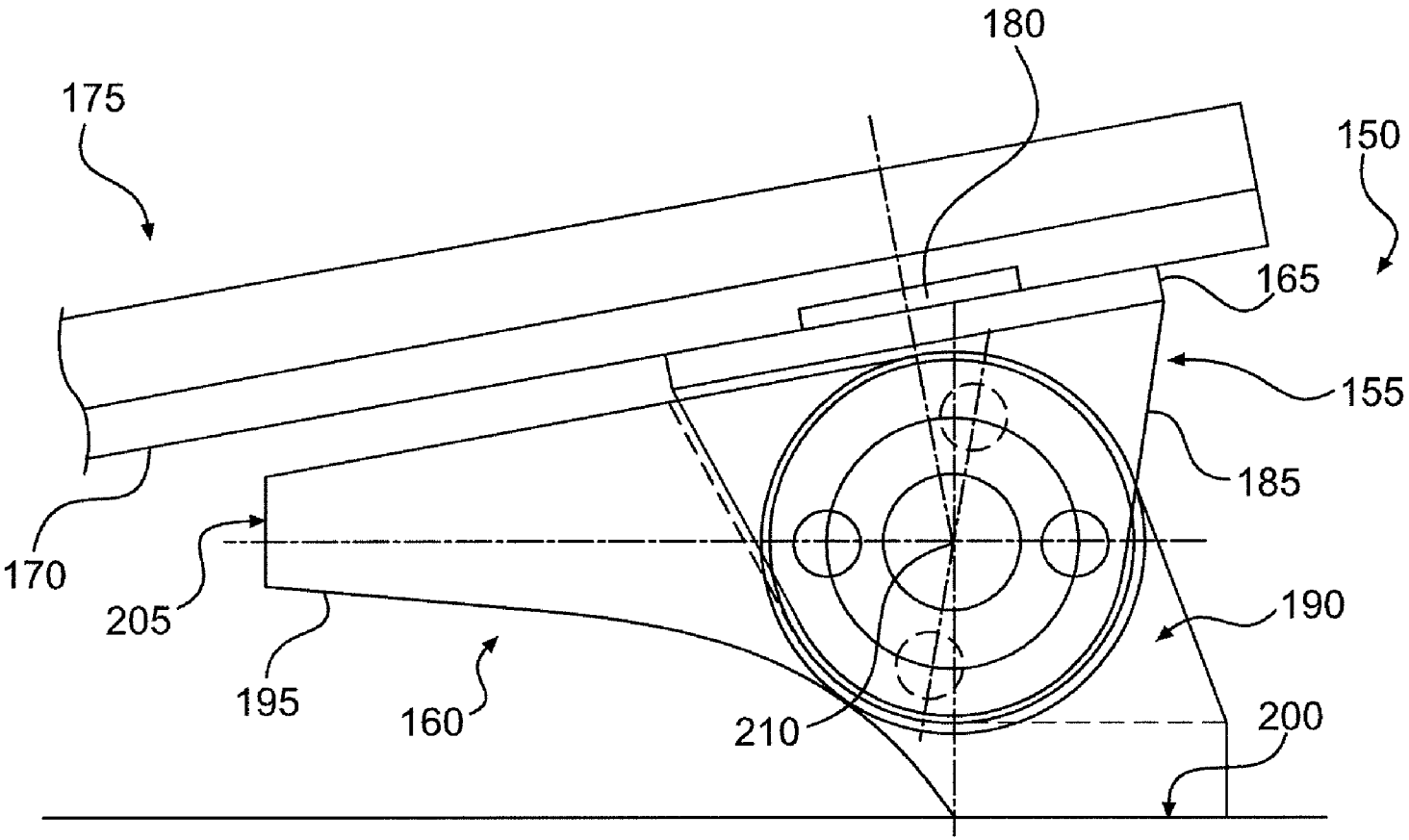
FIGS. 4 and 5 show a multi-position heel assembly according to aspects of the invention.
Figure 5:
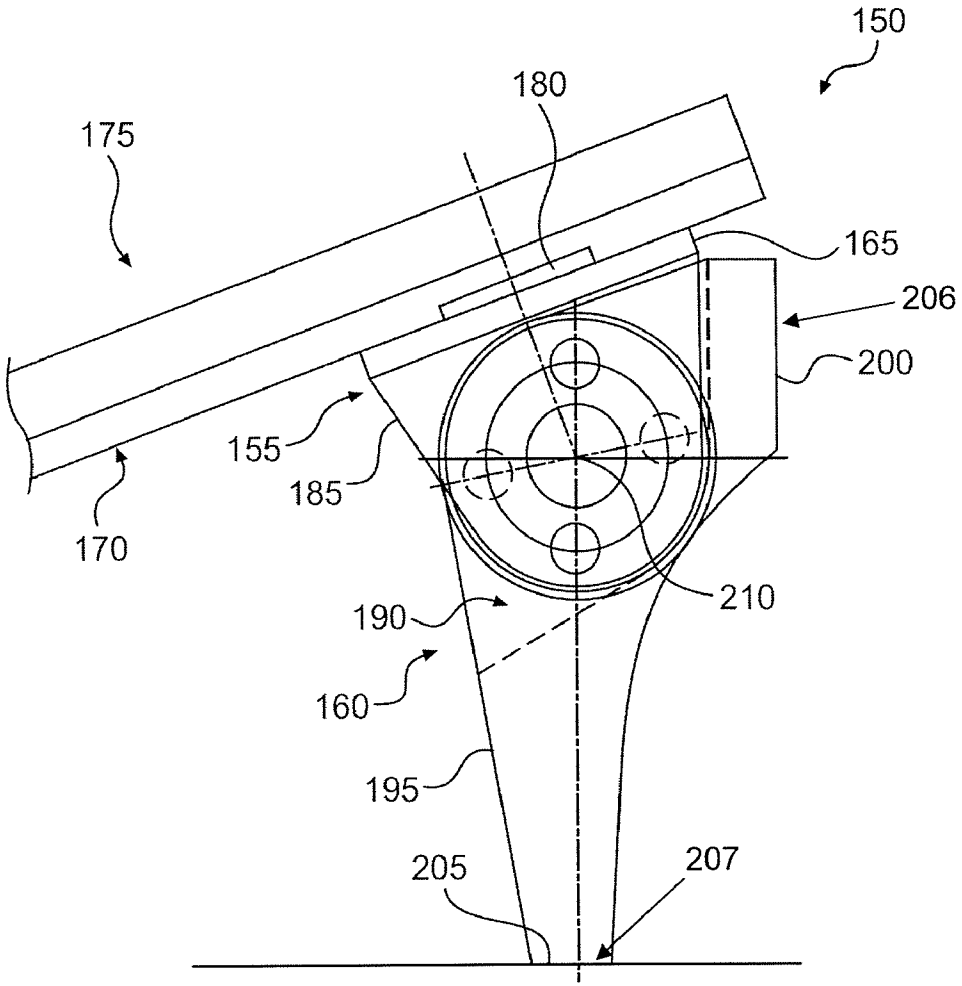

FIGS. 4 and 5 show an assembly 150 for a multi-position heel according to further aspects of the invention. In embodiments, the assembly 150 includes a chassis 155 and a heel 160, which may be similar in functionality to the chassis (e.g., 25, 110) and heel (e.g., 30, 100) described herein. In embodiments, the chassis 155 comprises a body 165 that sits substantially flush against the sole 170 of the shoe 175. The body 165 may optionally comprise a mounting stud 180 to facilitate mounting the chassis 155 to the shoe 175. For example, the mounting stud 180 may comprise a protrusion extending from the top side of the body 165 and held within a portion of the sole 170, the protrusion facilitating adhering and/or mechanical fastening (e.g., via screws, tacks, etc.) of the chassis 155 to the shoe 175. Alternatively, the chassis 155 may be integrally formed with the shoe 175. In further embodiments, the chassis 155 includes a flange 185 extending downward from the lower side of the body 165, the flange being arranged to fit within a groove 190 of the heel 160.

In implementations of the invention, the heel 160 includes a body 195 having a first engagement surface 200 and a second engagement surface 205. The heel 160 is structured and arranged to rotate about axis 210. The first engagement surface 200 is arranged to contact the ground, floor, etc., when the heel 160 is selectively rotated to the first heel position (e.g., FIG. 4), while the second engagement surface 205 is arranged to contact the ground, floor, etc., when the heel 160 is selectively rotated to the second heel position (e.g., FIG. 5). Similar to the assembly described with respect to FIG. 1, the body 195 of the heel 160 is shaped such that when the assembly is arranged in the first heel position (e.g., FIG. 4), the sole 170 of the shoe 175 is arranged at a first height, and when the assembly is arranged in the second heel position (e.g., FIG. 5), the sole 170 of the shoe 175 is arranged at a second height different from the first height. However, in alternative embodiments, the first heel position and the second heel position may be configured such that the first height is substantially equal to the second height.

According to further aspects of the invention, the first and second engagement surfaces 200 and 205 may comprise different structures and/or materials. As a non-limiting example, one of the first and second engagement surfaces 200 and 205 may comprise a relatively smooth surface, while the other one of the first and second engagement surfaces 200 and 205 comprises a relatively rough surface. For example, the first engagement surface 200 may comprise an aggressive tread pattern 206 having deep grooves formed between protrusions (e.g., similar to a hiking boot tread), while the second engagement surface 205 comprises a relatively smooth rubber or leather surface 207 (e.g., similar to found in dress shoes).

Other materials and structures may also be used for the respective engagement surfaces of any of the embodiments. For example, in embodiments, both the first and second engagement surfaces 200 and 205 may comprise, but are not limited to, the following structures: smooth, knurled, hiking tread, studs, one or more wheels rotatable about an axis, a mounting structure (e.g., a rail) for selectively attaching a bicycle pedal clip, ice skate blade, roller blade wheels, etc. Moreover, the first and second engagement surfaces 200 and 205 may be composed of any suitable material, including, but not limited to: rubber, plastic, leather, wood, metal, etc. The first and second engagement surfaces 200 and 205 may be composed of the same or different materials.

Furthermore, one or more stylized logos (or other indicia) may be added to or integrally formed in one or both of the first and second engagement surfaces 200 and 205. For example, a company logo may be integrally and structurally formed (e.g., molded) in the material (e.g., rubber) of one of the first and second engagement surfaces 200 and 205. In particular embodiments, a distinctive tread pattern, a logo, or indicia are arranged on or integrally formed with the first engagement surface 200. In this way, when the heel is arranged in the second heel position (e.g., FIG. 5), the second engagement surface 205 is configured to contact the ground, and the first engagement surface 200 (including the tread pattern, logo, and/or indicia) is configured to be visible from behind the shoe.

Figure 6B:
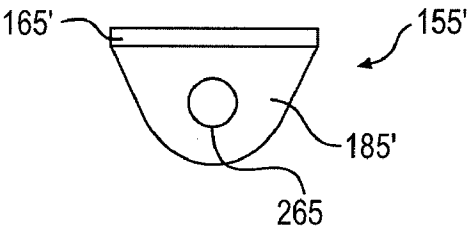
FIGS. 6, 6A, 6B, and 7-9 show aspects of a pushbutton locking mechanism according to aspects of the invention.

In embodiments, the assembly 150 may include a locking mechanism, such as, for example, one of those described with respect to FIGS. 6-12, described in greater detail below. For example, FIGS. 6-9 show aspects of an embodiment of a pushbutton locking mechanism according to aspects of the invention. Particularly, FIG. 6 shows an exploded view of an assembly comprising a pushbutton locking mechanism according to aspects of the invention. The assembly includes a chassis 155' having a body 165' and a flange 185'.

Figure 6A:
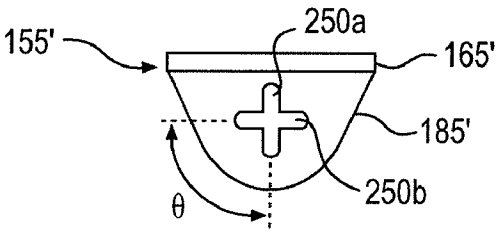
Figure 6:
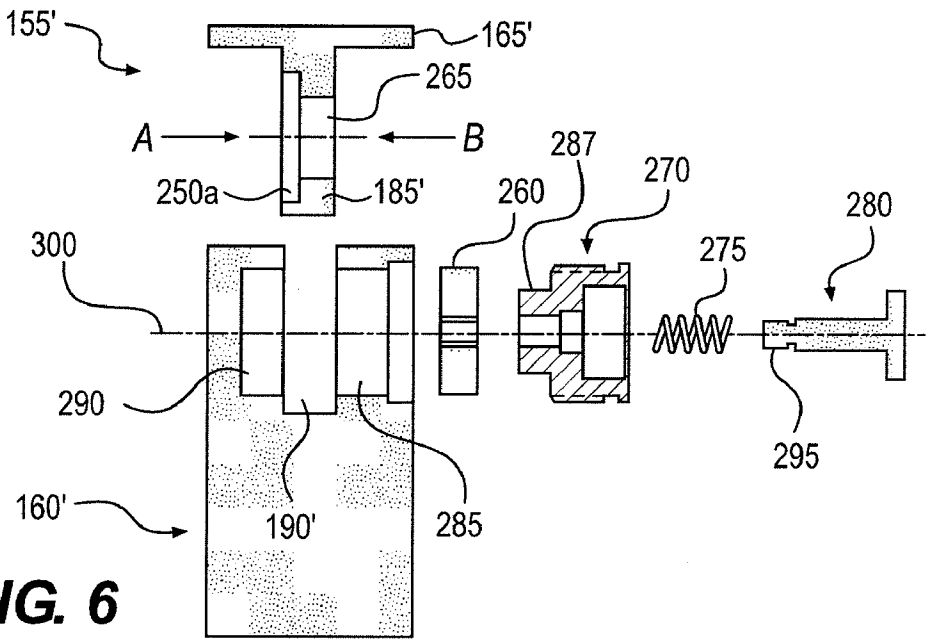

FIG. 6A shows the chassis 155' viewed along arrow "A" in FIG. 6. As seen in FIG. 6A, one side of the flange 185' includes two intersecting slots 250*a* and 250*b* that are arranged to hold a key 260 described in greater detail below. FIG. 6B shows the chassis 155' viewed along arrow "B" in FIG. 6. As depicted in FIG. 6B, an opposite side of the flange 185' includes a central bore 265 that is arranged to receive a pivot shaft 270, described in greater detail below.

Figure 7:
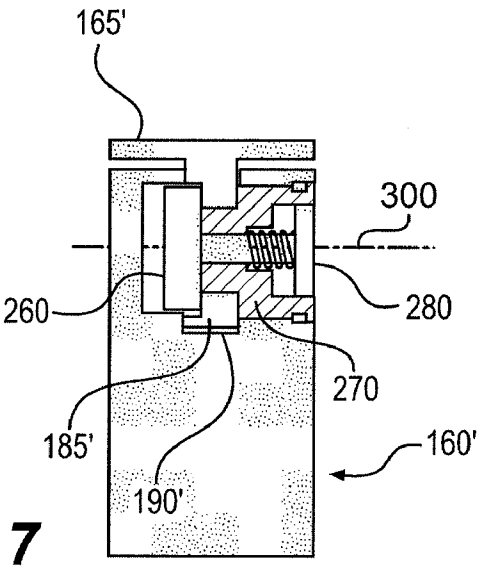

Still referring to FIG. 6, the heel 160' includes a groove 190' for receiving the flange 185'. The locking mechanism further includes a spring 275 and a pushbutton member 280. As depicted in FIGS. 6 and 7, when assembled, the flange 185' resides in the groove 190'. The pivot shaft 270 is fixedly connected within a bore 285 formed in the heel 160' on one side of the groove 190'. The pivot shaft 270 may be held in the bore 285 in any suitable manner, such as, for example, threaded connection, press fit, adhesive, etc. Moreover, an outer surface 287 of the pivot shaft 270 is rotatably disposed within the bore 265 of the flange 185'.

In embodiments, the pushbutton member 280 extends centrally through the pivot shaft 270 and into engagement with the key 260, which is arranged in a cavity 290 formed in the heel 160' on an side of the groove 190' opposite the insertion side of the pivot shaft 270. In embodiments, the cavity 290 is substantially the same shape as the key 260 but slightly larger than the key 260, so that the key 260 can be axially translated into and out of the cavity 290, but the key 260 cannot rotate to any appreciable extent within the cavity 290.

According to aspects of the invention, the pushbutton member 280 may translate along a bore centrally formed within the pivot shaft 270. An end 295 of the pushbutton member 280 is fixedly attached within a bore of the key 260 in any suitable manner, such as, for example, by threaded connection, press fit, adhesive, etc. Spring 275, which is arranged between the pivot shaft 270 and the pushbutton member 280, biases the pushbutton member 280 outward (e.g., away from the flange 185'). When assembled, the bore in the key 260, the bore 265 in the flange 185', the pivot shaft 270, and the pushbutton member 280 are all substantially coaxially aligned along axis 300. In embodiments, axis 300 is the same axis about which the heel 160 may rotate relative to the chassis 155', and also is the same axis about which pushbutton member 280 may translate axially upon sufficient force applied from a user.

Figure 9:
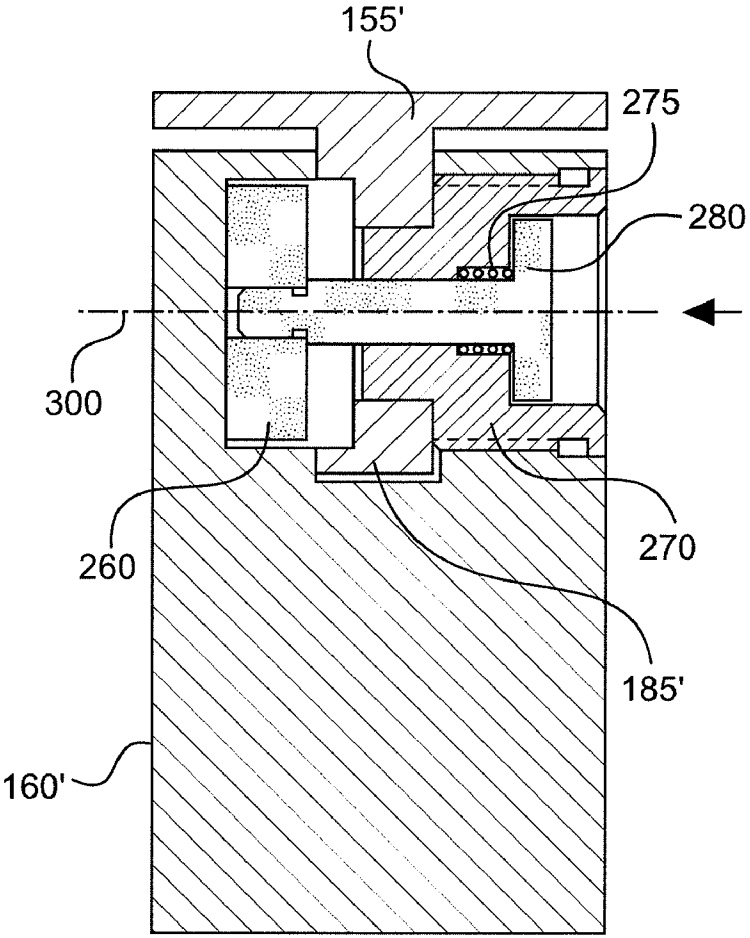
Figure 8:
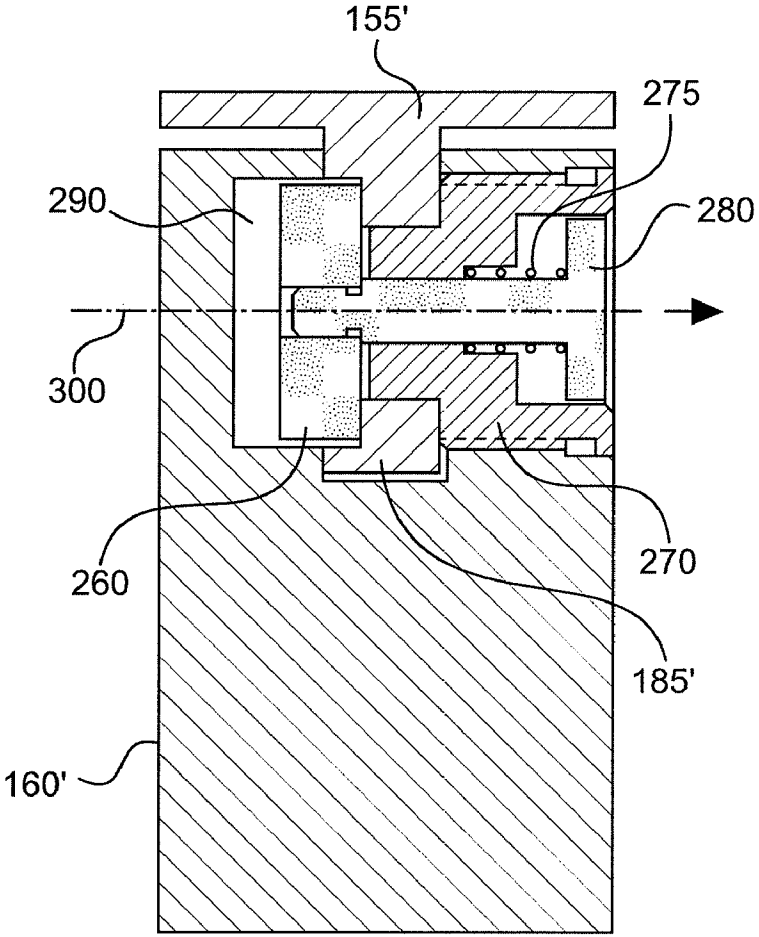

As depicted in FIG. 8, the spring 275 biases the pushbutton member 280 outward, thereby biasing the key 260 into one of the slots 250*a* or 250*b* of the flange 185'. When the key 260 is disposed in one of slots 250*a* or 250*b*, the heel 160' is locked, e.g., cannot rotate relative to the chassis 155'. As depicted in FIG. 9, when the pushbutton member 280 is pushed inward, the key 260 is moved out of the slot (either 250*a* or 250*b*), such that the heel 160', the pivot shaft 270, the key 260 and the pushbutton 280 may rotate relative to the chassis 155' about axis 300.

For example, in operation, when a user wishes to change the position of the heel 160', the pushbutton member 280 may be pushed inward to disengage the key 260 from the slot 250*a*. Then the user rotates the heel 160' relative to the chassis 155' until the key 260 is aligned with the other slot 250*b*, at which point the spring 275, through its uninterrupted bias of the pushbutton member 280 outward, causes the key 260 to move into engagement in the slot 250*b*. The same operation can be used in rotating the heel 160' from slot 250*b* to slot 250*a*. Accordingly, the positions of the slots 250*a* and 250*b* determine the first and second positions of the heel 160' (for example, as depicted in FIGS. 4 and 5). The angle θ between the 250*a* and 250*b* (shown in FIG. 6A) may be chosen as any desirable value to effectuate the different first and second positions of the heel 160'.

Figure 11:
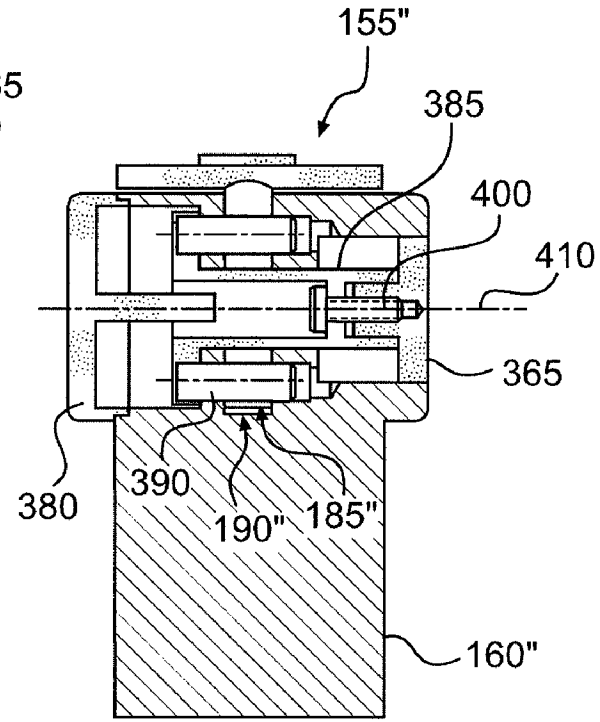
FIGS. 10-12 show aspects of another pushbutton locking mechanism according to aspects of the invention.
Figure 10:
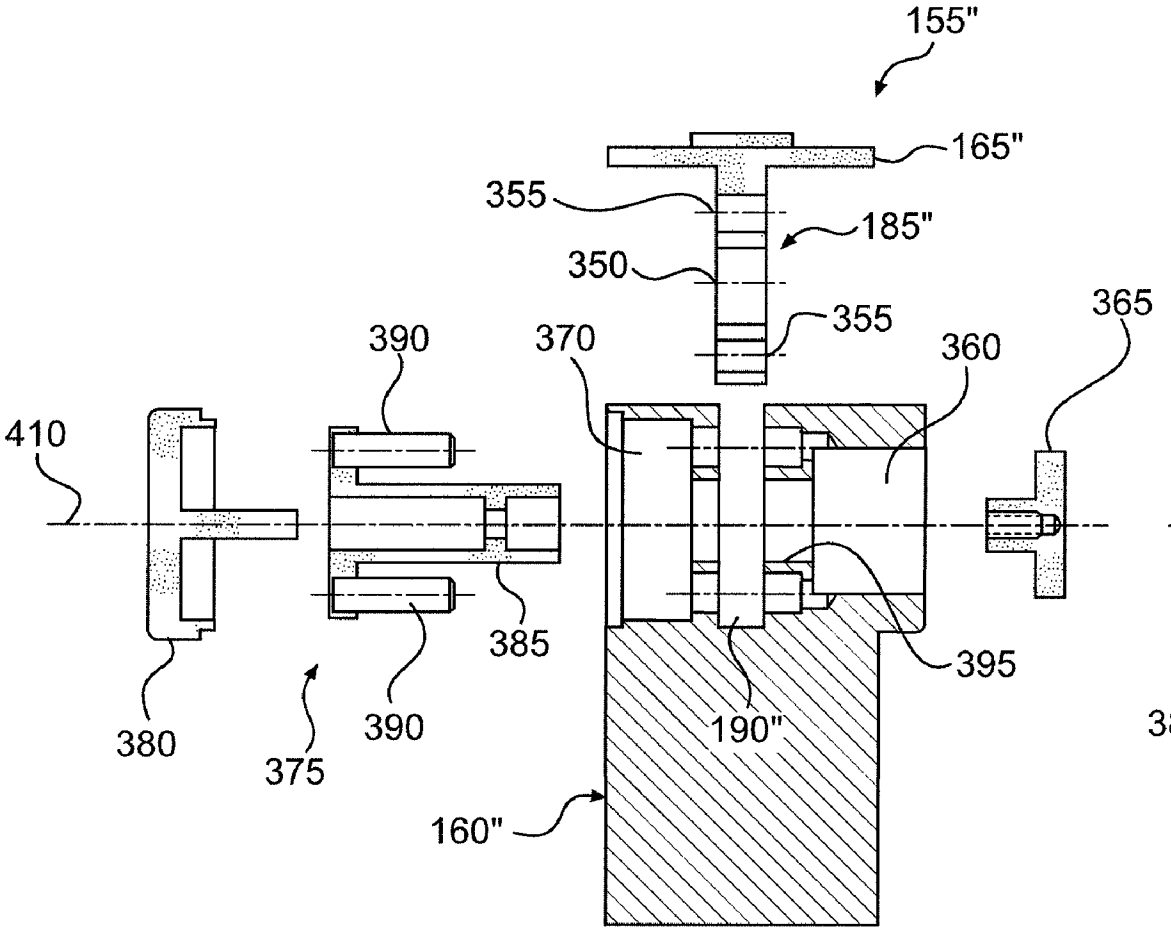
Figure 12:
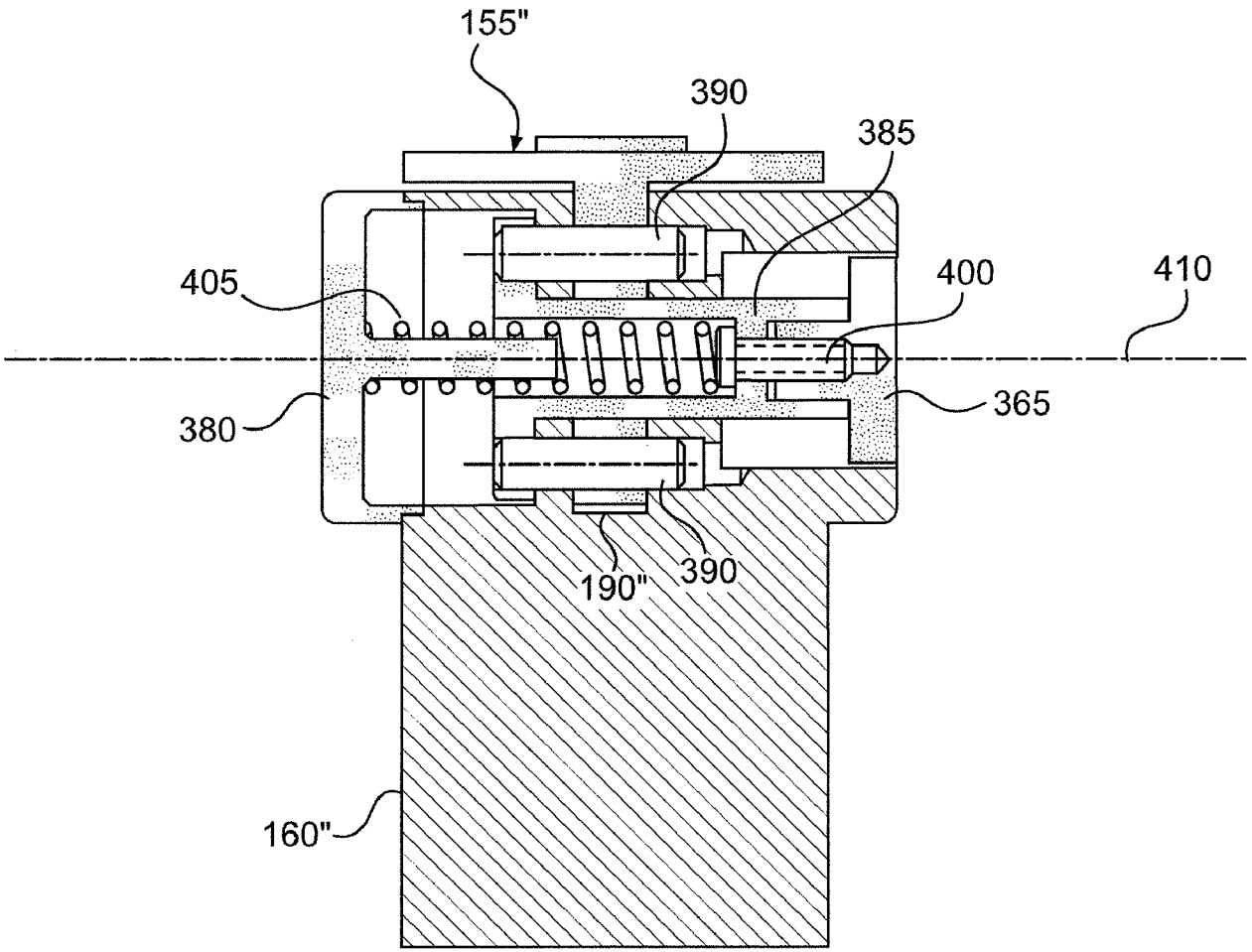

FIGS. 10-12 show an alternative pushbutton locking mechanism according to aspects of the invention. Particularly, FIG. 10 depicts a chassis 155" having a body 165" and a flange 185", which is arranged to be positioned within a groove 190" of a heel 160". The flange 185" includes a central bore 350 and a plurality of radially positioned bores 355.

In embodiments, the heel 160" includes a first cavity 360 on a first side of the groove 190" arranged to receive a pushbutton member 365. The heel 160" also includes a second cavity 370 on a second side of the groove 190" opposite the first side, the second cavity 370 being structured and arranged to accommodate a pivot pin assembly 375. A cap 380 encloses the pivot pin assembly 375 within the second cavity 370.

According to aspects of the invention, the pivot pin assembly 375 includes a pin holder 385 and at least one pin 390. As seen in FIGS. 10 and 11, when assembled, the pivot pin assembly 375 is positioned within and axially aligned with the central bore 350 of the flange 185". Moreover, the pivot pin assembly 375 is positioned within and axially aligned with a central bore 395 of the heel 160". Also, an end of the pin holder 385 is connected to the pushbutton member 365 by a cap screw 400, which may be joined in any suitable manner, including but not limited to: threaded fastening (e.g., threaded bolt or screw), adhesive, press fit, etc. Moreover, the cap 380 may be attached to the heel 160" by, for example, threaded connection, press fit, etc.

As depicted in FIG. 12, a spring 405 is captivated between the cap screw 400 and the cap 380. The spring 405 biases the pushbutton member 365 outward (e.g., away from the groove 190". As the cap screw 400 fixedly connects the pushbutton member 365 and the pin holder 385, the spring also serves to bias the pivot pin assembly 375 toward the groove 190". In embodiments, the pins 390 prevent rotation of the heel 160" relative to the chassis 155" when the pins 390 are positioned within and engage radial bores 355 of the flange 185", as depicted in FIG. 10.

According to aspects of the invention, when the pushbutton member 365 is pushed inward (e.g., toward the groove 190") with sufficient force to overcome the spring 405, the pivot pin assembly 375 slides axially along axis 410 toward the cap 380. At the same time, the pins 390 slide out of engagement with radial bores 355 (e.g., depicted in FIG. 10). When the pins 390 are clear of the radial bores 355, the heel 160" is free to rotate about axis 410 relative to the chassis 155". In embodiments, the heel may be rotated to a second position, in which the pins 390 align with another set of radial bores 355 in the flange 185", at which point the spring 405 biases the pin holder toward the groove 190", such that the pins slide axially into engagement with another set of radial bores 355 and lock the heel 160" relative to the chassis 155".

The engagement portion of the locking mechanism is not limited to one of the key and pin arrangements described herein. Instead, the engagement portion of the locking mechanism may comprise a key, one or more pins, a spline, gear, or any other shape suitable for locking and preventing rotation. Additionally, the engagement portion (e.g., key, pin (s), etc.) may be tapered to facilitate engagement and disengagement, and to insure a tight assembly after changing from one heel position to another.

In embodiments, the components described herein may be manufactured using any suitable materials. For example, the heel and/or chassis may be composed of, but are not limited to, the following materials: plastics, metals, and/or wood. In a particular embodiment, the heel and chassis are made of aluminum, such as anodized aluminum. In another embodiment, the heel and chassis are made of nylon, such as, for example, DELRIN (a registered trademark of E.I. DU PONT DE NEMOURS AND COMPANY in the United States and/or other countries). Moreover, in embodiments, the shoe to which the inventive multi-position heel assembly is attached may be specially designed, for example, with added flexibility in the metatarsal region to allow the shoe to remain comfortable in both the high heel and low heel positions.

The foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A multi-position heel assembly structured and arranged to be integrally formed with or mechanically connected to a shoe, comprising:

a chassis;

a heel connected to the chassis and rotatable relative to the chassis about an axis; and a locking mechanism comprising an actuator that is axially translatable along the axis, wherein the locking mechanism selectively allows rotation of the heel relative to the chassis, wherein the heel is rotatable about the axis between a first heel position and a second heel position;

the heel comprises a first engagement surface configured to contact the ground in the first heel position, the heel comprises a second engagement surface, different from the first engagement surface configured to contact the ground in the second heel position; wherein the actuator comprises a pushbutton biased toward a first position corresponding to a first state in which the locking mechanism prevents rotation of the heel relative to the chassis; and the actuator is coaxially aligned with the axis.

2. The assembly of claim 1, wherein:

the locking mechanism is structured and arranged to place the heel in one of the first state and a second state, in the first state, the locking mechanism prevents rotation of the heel relative to the chassis, and in the second state, the locking mechanism permits rotation of the heel relative to the chassis.

3. The assembly of claim 2, wherein the actuator further comprises a spring that biases the pushbutton.

4. The assembly of claim 2, wherein the pushbutton is translatable along the axis between the first position and a second position.

5. The assembly of claim 4, wherein the second position corresponds to the second state in which the locking mechanism allows rotation of the heel relative to the chassis.

6. The assembly of claim 4, wherein:

the pushbutton is substantially flush with an outermost side surface of the heel in the first position, and the pushbutton is recessed from the outermost side surface of the heel in the second position.

7. The assembly of claim 1, wherein the heel is arranged to be locked in one of the first heel position and the second heel position relative to the chassis.

8. The assembly of claim 7, wherein:

the first heel position provides the shoe with a first heel height, the second heel position provides the shoe with a second heel height, and the first heel height is different from the second heel height.

9. The assembly of claim 7, wherein:

the first heel position provides the shoe with a first heel height, the second heel position provides the shoe with a second heel height, and the first heel height is equal to the second heel height.

10. The assembly of claim 7, wherein:

the first engagement surface is composed of a first material, and the second engagement surface is composed of a second material different from the first material.

11. The assembly of claim 7, wherein the first engagement surface and the second engagement surface comprise a same material.

12. The assembly of claim 7, wherein the first engagement surface and the second engagement surface have differing tread patterns.

13. The assembly of claim 7, wherein:

when the heel is arranged in the first heel position:

the first engagement surface is configured to contact the ground, and the second engagement surface is configured to be located under an arch of the shoe, and when the heel is arranged in the second heel position:

the second engagement surface is configured to contact the ground, and the first engagement surface is configured to be visible from behind the shoe.

14. The assembly of claim 13, wherein the first engagement surface comprises at least one of: a tread pattern, a logo, and indicia.

15. The assembly of claim 14, wherein the at least one of the tread pattern, the logo, and the indicia is integrally formed with the first engagement surface.

16. The assembly of claim 1, wherein:

the pushbutton has a shaft and a key at one end of the shaft the key is arranged to engage one of two slots formed in the chassis to prevent rotation of the heel relative to the chassis, and the heel comprises a cavity for accommodating the key when the key is disengaged from the two slots to allow rotation of the heel relative to the chassis.

17. The assembly of claim 1, wherein:

the pushbutton is operatively connected to two pins the two pins are arranged to engage one of two pairs of holes formed in the chassis to prevent rotation of the heel relative to the chassis, and the heel comprises a cavity for accommodating the two pins when the two pins are disengaged from the two pairs of holes to allow rotation of the heel relative to the chassis.

18. A multi-position shoe, comprising:

a chassis integrally formed with or connected to a sole of the shoe;

a heel connected to the chassis and rotatable relative to the chassis about an axis;

a locking mechanism comprising a pushbutton that is axially translatable along the axis, wherein, upon depression of the pushbutton, the locking mechanism selectively allows rotation of the heel relative to the chassis;

first and second engagement surfaces on the heel configured for contacting the ground when the heel is arranged in respective first and second heel positions;

a pivot shaft;

a key at one end of the pushbutton; and two slots formed in the chassis, the two slots comprising a first slot associated with the first heel position and a second slot associated with the second heel position, wherein the key is configured to engage one of the two slots formed in the chassis to prevent rotation of the heel relative to the chassis, the heel comprises a cavity for accommodating the key when the key is disengaged from the two slots to allow rotation of the heel relative to the chassis, the pivot shaft is arranged in a first bore in the heel and a second bore in the chassis, the pushbutton is arranged in a third bore in the pivot shaft, and the pivot shaft and the pushbutton are coaxially aligned with the axis.

19. A multi-position shoe, comprising:

a chassis integrally formed with or connected to a sole of the shoe;

a heel connected to the chassis and rotatable relative to the chassis between a first heel position and a second heel position; and a locking mechanism comprising a spring-biased pushbutton that is axially translatable between a first position and a second position along an axis of rotation of the heel, wherein the pushbutton is coaxially aligned with the axis of rotation, wherein the heel is locked in one of the first heel position and the second heel position when the pushbutton is in the first position, the heel is moveable between the first heel position and the second heel position when the pushbutton is in the second position, the heel comprises a first engagement surface that is configured to contact the ground when the heel is in the first heel position, and the heel comprises a second engagement surface, different from the first engagement surface, that is configured to contact the ground when the heel is in the second heel position.

20. A multi-position heel assembly, comprising:

a chassis structured and arranged to be integrally formed with or mechanically connected to a shoe, wherein the chassis includes at least two detents radially spaced about an axis;

a heel pivotally connected to the chassis; and a locking mechanism, wherein the heel is arranged in a first heel position beneath the chassis when the locking mechanism is engaged with a first one of the at least two detents, the heel is arranged in a second heel position beneath the chassis, different from the first heel position, when the locking mechanism is engaged with a second one of the at least two detents, the heel is rotatable relative to the chassis about the axis when the locking mechanism is disengaged from the at least two detents, the at least two detents are on a convex outer surface of the chassis, the heel comprises a first engagement surface that is configured to contact the ground when the heel is in the first heel position, and the heel comprises a second engagement surface, different from the first engagement surface, that is configured to contact the ground when the heel is in the second heel position.

* * * * *